United States Patent [19]

Kalnes

[11] Patent Number: 4,931,165

[45] Date of Patent: Jun. 5, 1990

[54] PROCESS FOR REFRACTORY COMPOUND REJECTION FROM A HYDROCRACKER RECYCLE LIQUID

[75] Inventor: Tom N. Kalnes, La Grange, Ill.

[73] Assignee: UOP, Des Plaines, Ill.

[21] Appl. No.: 348,452

[22] Filed: May 4, 1989

[51] Int. Cl.[5] ..... C10G 13/00; C10G 37/00; C10G 45/72

[52] U.S. Cl. ..... 208/100; 208/48 R; 208/56; 208/60; 208/82; 208/84; 208/86; 208/102; 208/103; 208/104; 208/105; 208/108; 208/143; 585/266

[58] Field of Search ..... 208/56, 58, 60, 100, 208/102, 103, 104, 105, 108, 143, 82, 84, 48 R, 86; 585/266

[56] References Cited

U.S. PATENT DOCUMENTS

| | | | |
|---|---|---|---|
| 3,172,835 | 3/1965 | Scott, Jr. | 208/58 |
| 3,619,407 | 11/1971 | Attane et al. | 208/48 R |
| 3,666,658 | 5/1972 | Hallman | 208/103 |
| 4,447,315 | 5/1984 | Lamb et al. | 208/99 |
| 4,551,235 | 11/1985 | Carson | 208/100 |
| 4,604,185 | 8/1986 | McConaghy, Jr. et al. | 208/100 |
| 4,618,412 | 10/1986 | Hudson et al. | 208/59 |
| 4,673,488 | 6/1987 | Turner et al. | 208/103 |
| 4,696,733 | 9/1987 | Tsao | 585/260 |
| 4,698,146 | 10/1987 | Gruia | 208/86 |

*Primary Examiner*—Helane M. Myers

*Attorney, Agent, or Firm*—Thomas K. McBride; John G. Tolomei; John G. Cutts, Jr.

[57] ABSTRACT

A catalytic hydrocracking process which comprises: (a) contacting a hydrocarbonaceous feedstock having a propensity to form heavy polynuclear aromatic compounds and a liquid recycle stream in a hydrocracking zone to convert a substantial portion of the hydrocarbonaceous components in the feedstock to lower boiling products; (b) recovering a hydrocarbon effluent from the hydrocracking zone and partially condensing the hydrocarbon effluent from the hydrocracking zone and separating the same into a lower boiling hydrocarbon product stream and an unconverted hydrocarbon stream having at least a portion boiling above about 400° F. (204° C.) and comprising trace quantities of heavy polynuclear aromatic compounds; (c) introducing at least a portion of the unconverted hydrocarbon stream into a hydrogen stripping flash zone with a first hydrogen-rich gaseous stream having a temperature greater than the hydrocarbon stream at flash conditions thereby increasing the temperature of the hydrocarbon stream and vaporizing at least a portion thereof to produce a vapor stream comprising hydrogen and hydrocarbon compounds and produce a liquid hydrocarbon stream comprising heavy polynuclear aromatic compounds; (d) contacting the vapor stream comprising hydrogen and hydrocarbon compounds with a hydrogenation catalyst in a hydrogenation reaction zone to increase the hydrogen content of the hydrocarbon compounds contained in the vapor stream; (e) condensing at least a portion of the resulting effluent from the hydrogenation reaction zone to produce a second hydrogen-rich gaseous stream and a liquid stream comprising hydrogenated hydrocarbon compounds; and (f) recycling at least a portion of the liquid stream comprising hydrogenated hydrocarbon compounds recovered in step (e) to the hydrocracking zone in step (a).

11 Claims, 1 Drawing Sheet

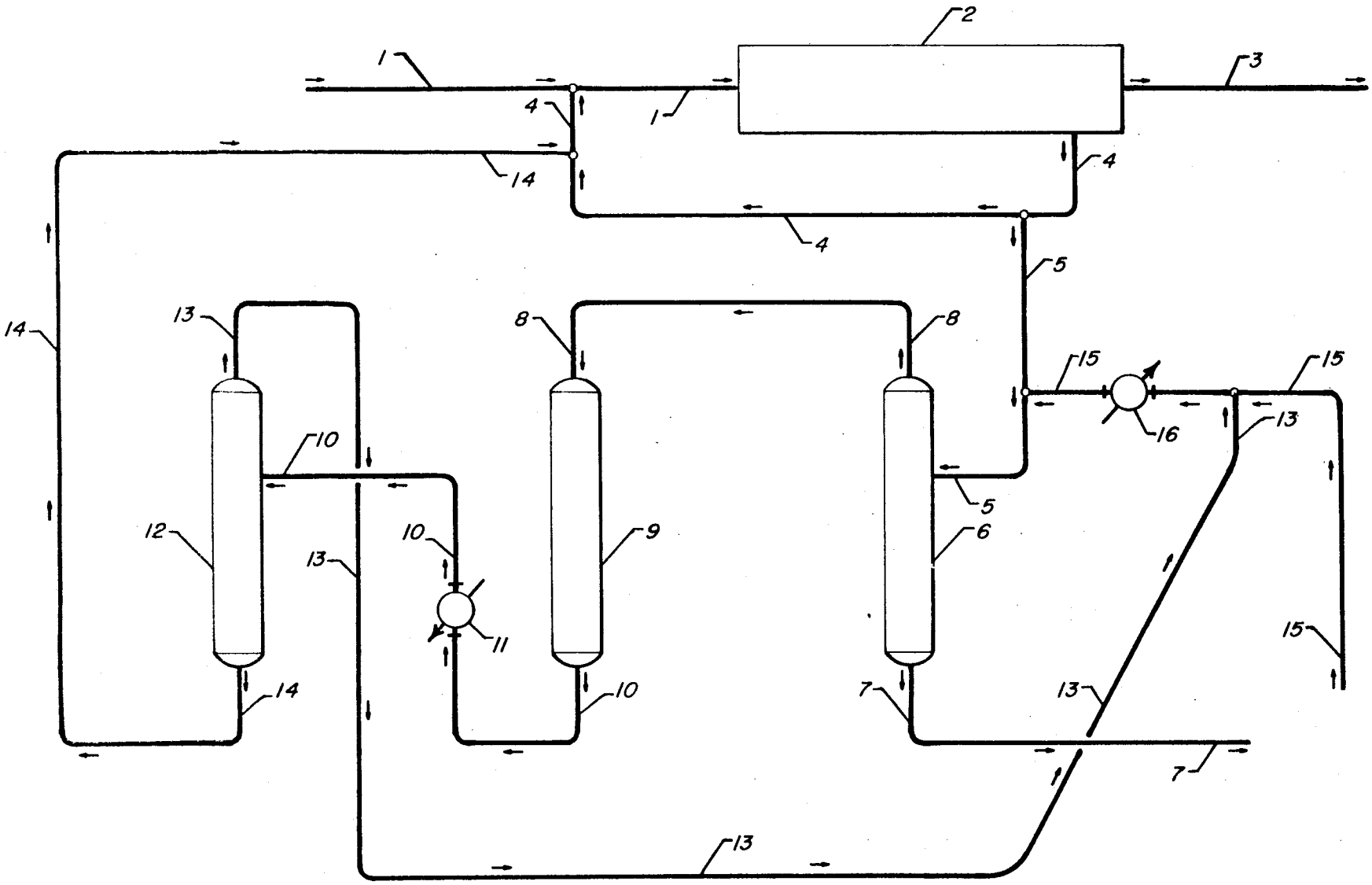
1
2
3
4
5
6
7
8
9
10
11
12
13
14
15
16

PROCESS FOR REFRACTORY COMPOUND REJECTION FROM A HYDROCRACKER RECYCLE LIQUID

BACKGROUND OF THE INVENTION

The field of art to which this invention pertains is the hydrocracking of a hydrocarbonaceous feedstock having a propensity to form heavy polynuclear aromatic compounds while avoiding excessive fouling in the hydrocracking processing unit. The heavy polynuclear aromatic compounds are considered to be refractory in a hydrocracking process, are thereby highly resistant to conversion and are therefore undesirable components in the fresh feed or recycle to a hydrocracking reaction zone. More specifically, the invention relates to a catalytic hydrocracking process which comprises: (a) contacting a hydrocarbonaceous feedstock having a propensity to form heavy polynuclear aromatic compounds and a liquid recycle stream in a hydrocracking zone with added hydrogen and a metal promoted hydrocracking catalyst at elevated temperature and pressure sufficient to convert a substantial portion of the hydrocarbonaceous components in the feedstock to lower boiling products; (b) recovering a hydrocarbon effluent from the hydrocracking zone and partially condensing the hydrocarbon effluent from the hydrocracking zone and separating the same into a lower boiling hydrocarbon product stream and an unconverted hydrocarbon stream having at least a portion boiling above about 400° F. (204° C.) and comprising trace quantities of heavy polynuclear aromatic compounds; (c) introducing at least a portion of the unconverted hydrocarbon stream having at least a portion boiling above about 400° F. (204° C.) and comprising trace quantities of heavy polynuclear aromatic compounds into a hydrogen stripping flash zone with a first hydrogen-rich gaseous stream having a temperature greater than the hydrocarbon stream at flash conditions thereby increasing the temperature of the hydrocarbon stream and vaporizing at least a portion thereof to produce a vapor stream comprising hydrogen and hydrocarbon compounds and produce a liquid hydrocarbon stream comprising heavy polynuclear aromatic compounds; (d) contacting the vapor stream comprising hydrogen and hydrocarbon compounds with a hydrogenation catalyst in a hydrogenation reaction zone at hydrogenation conditions to increase the hydrogen content of the hydrocarbon compounds contained in the vapor stream; (e) condensing at least a portion of the resulting effluent from the hydrogenation reaction zone to produce a second hydrogen-rich gaseous stream and a liquid stream comprising hydrogenated hydrocarbon compounds; and (f) recycling at least a portion of the liquid stream comprising hydrogenated hydrocarbon compounds recovered in step (e) to the hydrocracking zone in step (a) as at least a portion of the liquid recycle stream.

INFORMATION DISCLOSURE

In U.S. Pat. No. 4,447,315 (Lamb et al), a method is disclosed for hydrocracking a hydrocarbon feedstock having a propensity to form polynuclear aromatic compounds which method includes contacting the hydrocarbon feedstock with a crystalline zeolite hydrocracking catalyst, contacting at least a portion of the resulting unconverted hydrocarbon oil containing polynuclear aromatic compounds with an adsorbent which selectively retains polynuclear aromatic compounds and recycling unconverted hydrocarbon oil having a reduced concentration of polynuclear aromatic compounds to the hydrocracking zone.

In U.S. Pat. No. 3,619,407 (Hendricks et al), a process is claimed to prevent fouling of the equipment in a hydrocracking process unit which comprises partially cooling the effluent from the hydrocracking zone to effect condensation of a minor proportion of the normally liquid hydrocarbons therein, thereby forming a polynuclear aromatic rich partial condensate and withdrawing a bleedstream of the partial condensate. The '407 patent acknowledges as prior art that the hereinabove mentioned fouling problem may also be solved by subjecting the recycle oil (the heavy portin of the hydrocracking zone effluent), or a substantial portion thereof, to atmospheric distillation or vacuum distillation to separate out a heavy bottom fraction containing polynuclear aromatic compounds.

In U.S. Pat. No. 4,698,146 (Gruia), a process is disclosed wherein a vacuum gas oil feed stream is prepared in a fractionation zone and converted in a hydrocracking zone. An uncoverted vacuum gas oil stream containing polynuclear aromatic compounds and recovered from the effluent of the hydrocracking zone is introduced into the original feed preparation fractionation zone in order to remove and harvest the polynuclear aromatic compounds in a slop wax stream to prevent their recycle to the hydrocracking zone with the vacuum gas oil feed.

In U.S. Pat. No. 3,172,835 (Scott, Jr.), a process is disclosed wherein at least a portion of the recycle stream is hydrogenated to reduce the concentration of polynuclear aromatics therein.

In U.S. Pat. No. 4,618,412 (Hudson et al), a process is disclosed wherein at least a portion of the unconverted hydrocarbon oil in a hydrocracking process and containing polynuclear aromatic compounds is contacted with an iron catalyst to hydrogenate and hydrocrack the polynuclear aromatic hydrocarbon compounds and recycling the unconverted hydrocarbon oil having a reduced concentration of polynuclear aromatic compounds to the hydrocracking zone.

BRIEF SUMMARY OF THE INVENTION

The present invention is a catalytic hydrocracking process which minimizes the fouling of the process unit with heavy polynuclear aromatic compounds by means of flashing a slipstream of recycle hydrocarbon liquid containing trace quantities of heavy polynuclear aromatic compounds with a hydrogen-rich gaseous stream to generate a concentrated liquid stream of heavy polynuclear aromatic compounds and a vaporized stream containing hydrogen and having a reduced concentration of heavy polynuclear aromatic compounds. The resulting vaporized stream is hydrogenated in a hydrogenation zone to convert and thereby further lowering the concentration of the heavy polynuclear aromatic compounds. These steps significantly minimize the introduction of the undesirable heavy polynuclear aromatic compounds into the hydrocracking zone.

One embodiment of the present invention relates to a catalytic hydrocracking process which comprises: (a) contacting a hydrocarbonaceous feedstock having a propensity to form heavy polynuclear aromatic compounds and a liquid recycle stream in a hydrocracking zone with added hydrogen and a metal promoted hydrocracking catalyst at elevated temperature and pressure sufficient to convert a substantial portion of the hydrocarbonaceous components in the feedstock to lower boiling products; (b) recovering a hydrocarbon effluent from the hydrocracking zone and partially condensing the hydrocarbon effluent from the hydrocracking zone and separating the same into a lower boiling hydrocrabon product stream and an unconverted hydrocarbon stream having at least a portion boiling above about 400° F. (204° C.) and comprising trace quantities of heavy polynuclear aromatic compounds; (c) introducing at least a portion of the unconverted hydrocarbon stream having at least a portion boiling above about 400° F. (204° C.) and comprising trace quantities of heavy polynuclear aromatic compounds into a hydrogen stripping flash zone with a first hydrogen-rich gaseous stream having a temperature greater than the hydrocarbon stream at flash conditions thereby increasing the temperature of the hydrocarbon stream and vaporizing at least a portion thereof to produce a vapor stream comprising hydrogen and hydrocarbon compounds and produce a liquid hydrocarbon stream comprising heavy polynuclear aromatic compounds; (d) contacting the vapor stream comprising hydrogen and hydrocarbon compounds with a hydrogenation catalyst in a hydrogenation reaction zone at hydrogenation conditions to increase the hydrogen content of the hydrocarbon compounds contained in the vapor stream; (e) condensing at least a portion of the resulting effluent from the hydrogenation reaction zone to produce a second hydrogen-rich gaseous stream and a liquid stream comprising hydrogenated hydrocarbon compounds; and (f) recycling at least a portion of the liquid stream comprising hydrogenated hydrocarbon compounds recovered in step (e) to the hydrocracking zone in step (a) as at least a portion of the liquid recycle stream.

Other embodiments of the present invention encompass further details such as types and descriptions of feedstocks, hydrocracking catalysts, hydrogenation catalysts, preferred fractionation and flash separation schemes, and preferred operating conditions including temperature and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and not be a limitation thereof.

DETAILED DESCRIPTION OF THE INVENTION

It has been discovered that the process of the present invention can operate at higher on-stream efficiencies by concentrating and selectively removing refractory heavy polynuclear aromatic compounds from the recycle liquid stream. The removal of these compounds results in reduced fouling and/or precipitation problems.

It has been discovered that the heavy polynuclear aromatic compounds are primarily responsible for the fouling problems associated with the high conversion of hydrocarbon feedstock in a hydrocracking zone. Therefore, it becomes highly desirable to minimize the concentration of heavy polynuclear aromatic compounds (HPNA) which are recycled to the hydrocracking reaction zone in order to ensure trouble free operation and long run length.

In accordance with the present invention, it has been discovered that when at least a portion of the unconverted hydrocarbon effluent from a hydrocracking reaction zone is flashed with a hydrogen-rich gaseous stream to generate a vaporized stream containing hydrogen and subsequently hydrogenating the vaporized stream while simultaneously rejecting a small liquid stream containing heavy polynuclear aromatic compounds from the flash zone, a significant portion of the heavy polynuclear aromatic compounds is removed and prevented from being introduced into the hydrocracking zone.

In some cases where the concentration of heavy polynuclear aromatic compounds foulants is small, only a portion of unconverted hydrocracking zone effluent oil may need to be flashed and hydrogenated to remove a substantial portion of the heavy polynuclear aromatic compounds in the recycle stream in order to maintain the heavy polynuclear aromatic compounds at concentration levels below that which promote precipitation and subsequent plating out on heat exchanger surfaces. The expression "trace quantities of heavy polynuclear aromatic compounds" as used herein is preferably described as a concentration of less than about 1000 parts per million (PPM) and more preferably less than about 100 PPM.

The hydrocarbonaceous feed stock subject to processing in accordance with the process of the present invention preferably comprises a component selected from the group consisting of a vacuum gas oil, atmospheric gas oil, cracked gas oil, light cycle oil, heavy cycle oil, demetallized oil and coker gas oil.

The selected feedstock is introduced into a hydrocracking zone. Preferably, the hydrocracking zone contains a catalyst which comprises in general any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves, and are usually composed of silica, alumina and one or more exchangeable cations such as sodium, magnesium, calcium, rare earth metals, etc. They are further characterized by crystal pores of relatively uniform diameter between about 4 and 14 A. It is preferred to employ zeolites having a relatively high silica/alumina mole ratio between about 3 and 12, and even more preferably between about 4 and 8. Suitable zeolites found in nature include for example mordenite, stilbite, heulandite, ferrierite, dachiardite, chabazite, erionite and faujasite. Suitable synthetic zeolites include for example the B, X, Y and L crystal types, e.g., synthetic faujasite and mordenite. The preferred zeolites are those having crystal pore diameters between about 8–12 A, wherein the silica/alumina mole ratio is about 4 to 6. A prime example of a zeolite falling in this preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at leat about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°-1200° F. (371°-648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 850° F. (454° C.), a pressure from about 500 psig (3448 kPa gauge) to about 3000 psig (20685 kPa gauge), a liquid hourly space velocity (LHSV) from about 0.2 to about 20 hr.$^{-1}$, and a hydrogen circulation rate from about 2000 (337 normal $m^3/m^3$) to about 15,000 (2528 normal $m^3/m^3$) standard cubic feet per barrel.

After the hydrocarbonaceous feedstock has been subjected to hydrocracking as hereinabove described, a product stream boiling at a temperature less than the feedstock is separated and recovered, and a hydrocarbonaceous stream preferably boiling at a temperature greater than about 400° F. (204° C.) is separated and recovered as a recycle stream. This separation and recovery is preferably conducted in a fractionation zone associated with the hydrocracking zone. At least a portion of the hereinabove described recycle stream is introduced into the hydrogen stripping flash zone.

In accordance with the subject invention, at least a portion of the recycle stream containing heavy polynuclear aromatic compounds is contacted with a hot hydrogen-rich gaseous stream in a hydrogen stripping flash zone at flash conditions thereby vaporizing at least a portion thereof to provide a hydrocarbonaceous vapor stream containing hydrogen, hydrocarbon, and a reduced concentration of heavy polynuclear aromatic compounds and a liquid hydrocarbonaceous stream rich in heavy polynuclear aromatic compounds. The hot hydrogen-rich gaseous stream preferably comprises more than about 70 mole % hydrogen and more preferably more than about 90 mole % hydrogen. The hot hydrogen-rich gaseous stream is multi-functional and serves as (1) a heat source, (2) a diluent to reduce the partial pressure of the hydrocarbonaceous compounds during vaporization in the flash zone, (3) a possible reactant to minimize the formation of hydrocarbonaceous polymers at elevated temperatures, (4) a stripping medium and (5) at least a portion of the hydrogen required in the subsequent hydrogenation reaction zone. The hot hydrogen-rich gaseous stream is introduced in the flash zone preferably at a temperature from about 200° F. (93° C.) to about 1200° F. (649° C.)

During the contacting, the flash zone is preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on the hydrocarbonaceous feed stream to the flash zone and an average residence time of the hydrogen-containing, hydrocarbonaceous vapor stream in the flash zone from about 0.1 seconds to about 50 seconds. A more preferred average residence time of the hydrogen-containing, hydrocarbonaceous vapor stream in the flash zone is from about 1 second to about 10 seconds.

The resulting liquid portion in the flash zone is removed from the bottom of the flash zone as required to yield a heavy hydrocrbonaceous liquid stream rich in heavy polynuclear aromatic compounds which are generally present at a concentration of about 1500 ppm to about 5 weight percent.

The resulting hydrogen-containing, hydrocarbonaceous vapor stream having trace quantities (100 ppm, for example) of heavy polynuclear aromatic compounds is removed from the flash zone and is introduced into a catalytic hydrogenation zone containing hydrogenation catalyst and maintained at hydrogenation conditions. The catalytic hydrogenation zone may contain a fixed, ebullated or fluidized catalyst bed. This reaction zone is preferably maintained under an imposed pressure from about atmospheric (0 kPa gauge) to about 3000 psig (20685 kPa gauge) and more preferably under a pressure from about 100 psig (689.5 kPa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable heavy polynuclear aromatic compounds contained in the hydrocarbonaceous vapor stream. In accordance with the present invention, the primary function of the hydrogenation zone is to hydrogenate and convert heavy polynuclear aromatic compounds, however, it is contemplated that hydrogenation conversion may also include, for example, desulfurization, denitrification, olefin saturation and mild hydrocracking. Further preferred operation conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 30,000 SCFB (5056 normal $m^3/m^3$).

In the event that the temperature of the hydrogen-containing, hydrocarbonaceous stream which is removed from the flash zone is not deemed to be exactly the temperature selected to operate the catalytic hydrogenation zone, it is contemplated that the temperature of the hydrogen-containing, hydrocarbonaceous stream may be adjusted either upward or downward in order to achieve the desired temperature in the catalytic hydrogenation zone. Such a temperature adjustment may be accomplished, for example, by either heat-exchange or the addition of either cold or hot hydrogen.

The preferred catalytic composite disposed within the hereinabove described hydrogenation zone can be characterized as containing a metallic component having hydrogenation activity, which component is combined with a suitable refractory inorganic oxide carrier material of either synthetic or natural origin. The use of carbon based catalysts are contemplated to be within the scope of the present invention. The precise composition and method of manufacturing the carrier material is not considered essential to the present invention. Preferred carrier materials are alumina, silica, carbon and mixtures thereof. Suitable metallic components having hydrogenation activity are those selected from the group comprising the metals of Groups VI-B and VIII of the periodic Table, as set forth in the *Periodic Table of the Elements*, E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, ribidium, sodium, copper, gold, silver, cadmium, mercury and zinc.

The hydrocarbonaceous effluent from the hydrogenation zone is preferably cooled, partially condensed and admitted to a separation zone in order to separate a hydrogenated hydrocarbonaceous liquid phase and a hydrogen-rich gaseous phase which is preferably recycled. The resulting hydrogenated hydrocarbonaceous liquid phase having a reduced concentration of heavy polynuclear aromatic compounds is recovered and the hydrogen-rich gaseous phase may be recycled to the flash zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. The resulting hydrogenated hydrocarbonaceous liquid having a reduced concentration of heavy polynuclear aromatic compounds is then introduced into the hydrocracking zone directly or may be admixed with the fresh feed or any recycle stream which has not been subjected to a hydrogenation zone before introduction into the hydrocracking zone.

In accordance with the present invention, the hydrocarbonaceous liquid stream containing heavy polynuclear aromatic compounds recovered from the flash zone is recovered for further disposal or utilization. Since it is desirable to remove the maximum amount of heavy polynuclear aromatic compounds with this liquid stream and to maximize the product from the hydrocracking zone, this liquid stream is preferably less than about 2 volume percent and more preferably less than about 1 volume percent of the hydrocarbonaceous feedstock.

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

DESCRIPTION OF THE DRAWING

With reference now to the drawing, a vacuum gas oil feed stream is introduced into the process via conduit 1 and introduced into hydrocracking zone 2. A hydrocracked hydrocarbon product stream boiling at a temperature less than about 650° F. (343° C.) is recovered from hydrocracking zone 2 via conduit 3. An unconverted hydrocarbonaceous recycle stream is removed from hydrocracking zone 2 via conduit 4. A portion of the unconverted hydrocarbonaceous recycle stream is returned to hydrocracking zone 2 via conduit 4 and conduit 1. Another portion of the unconverted hydrocarbonaceous recycle stream is removed from hydrocracking zone 2 via conduit 4 and conduit 5 and is contacted with a hydrogen-rich gaseous stream provided via conduit 15 and hereinafter described, and the resulting admixture is introduced via conduit 5 into hydrogen stripping flash zone 6. A liquid hydrocarbonaceous stream containing heavy polynuclear aromatic compounds is removed from hydrogen stripping flash zone 6 via conduit 7 and recovred. A hydrocarbonaceous vapor stream containing hydrogen, hydrocarbon and trace quantities of heavy polynuclear aromatic compounds is removed from hydrogen stripping flash zone 6 via conduit 8 and is introduced into hydrogenation zone 9 to hydrogenate any remaining heavy polynuclear aromatic compounds which are present. A hydrogenated hydrocarbonaceous stream containing a reduced concentration of heavy polynuclear aromatic compounds is removed from hydrogenation zone 9 via conduit 10, cooled in heat exchanger 11 and introduced into high pressure separator 12 via conduit 10. A hydrogen-rich gaseous stream is removed from high pressure separator 12 via conduit 13, is admixed with make-up hydrogen provided via conduit 15 and the resulting admixture is heated in heat exchanger 16 and the resulting heated mixture is introduced into hydrogen stripping flash zone 6 via conduit 15 and conduit 5. Since hydrogen is lost in the process by means of a portion of the hydrogen being dissolved in the exiting liquid hydrocarbon and hydrogen being consumed during the hydrogenation reaction, it is necessary to supplement the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 15 as hereinabove described. A liquid hydrogenated hydrocarbonaceous stream containing dissolved hydrogen and a reduced concentration of heavy polynuclear aromatic compounds is removed from high pressure separated 12 via conduit 14 and is introduced into hydrocracking zone 2 via conduits 14, 4 and 1.

The following examples are given to illustrate further the catalytic hydrocracking process of the present invention. The examples are not to be construed as undue limitations on the generally broad scope of the invention as set out in the appended claims and are therefore intended to be illustrative rather than restrictive.

EXAMPLE I

A heavy vacuum gas oil/demetallized oil feedstock blend in the amount of 100 mass units per hour and a hereinafter described hydrocarbon recycle stream having the properties presented in Table 1 in an amount of 39 mass units per hour were introduced into a hydrocracking zone with hydrogen in an amount of 10,000 standard cubic feet per barrel (1685 normal $m^3/m^3$) of fresh feedstock. The hydrocracking zone contained two fixed beds of catalyst. The first bed of catalyst contained a silica-alumina support containing nickel and tungsten and was operated at a liquid hourly space velocity of about 0.4 and an average catalyst temperature of about 734° F. (390° C.). The second bed of catalyst contained an alumina-silica zeolite Y support containing nickel and tungsten and was operated at a liquid hourly space velocity of about 1 and an average catalyst temperature of about 660° F. (349° C). Both beds of catalyst were operated at a pressure of about 2400 psig (16548 kPa gauge). The effluent from the catalyst beds was cooled to about 120° F. (49° C.) and then was passed to a high pressure separator which was maintained at about 2000 psig (13790 kPa gauge). A hydrogen-rich gaseous stream was removed from the high pressure separator and recycled together with fresh make-up hydrogen to the hydrocracking catalyst zone. The liquid hydrocarbons from the high pressure separator were charged to a fractionator wherein $C_5$-plus liquid hydrocarbons boiling below about 650° F. (343° C.) were separated and withdrawn as product in an amount of 90 mass units per hour. The hydrocarbons boiling at a temperature greater than about 650° F. (343° C.) in an amount of 39 mass units per hour and containing about 600 weight parts per million (WPPM) heavy polynuclear aromatic compounds are withdrawn from the fractionator. A slipstream of 5 mass units per hour of the hydrocarbons boiling at a temperature greater than about 650° F. (343° C.) and recovered from the fractionator was introduced into a hydrogen stripping flash zone with a hydrogen-rich gaseous stream at a rate of 20,000 SCFB (3370 normal $m^3/m^3$). The hydrogen stripping flash zone was maintained at a pressure of 205 psig (1413 kPa gauge) and a temperature of 775° F. (413° C.) to produce a hydrocarbon vapor stream containing hydrogen which was introduced into a hydrogenation reaction zone containing a hydrogenation catalyst and maintained at a pressure of 200 psig (1379 kPa gauge) and a temperature of 400° F. (204° C.). The hydrogen stripping flash zone also produced a liquid hydrocarbon stream in an amount of 1 mass units per hour and containing >3000 wppm heavy polynuclear aromatic compounds. The hydrogenation reaction zone contained a catalyst containing alumina and palladium and produced an effluent stream which was partially condensed to yield a hydrogen-rich gaseous stream which was recycled to the hydrogen stripping flash zone and a liquid hydrocarbon stream in an amount of 4 mass units per hour and containing 28 wppm heavy polynuclear aromatic compounds.

The remaining hydrocarbon boiling at a temperature greater than about 650° F. (343° C.) recovered from the fractionator in an amount of 34 mass units per hour and the liquid hydrocarbon recovered from the effluent of the hydrogenation zone was then introduced into the hydrocracking reaction zone as a combined recycle stream.

TABLE 1

| Hydrocracker Recycle Liquid | |
|---|---|
| Specific Gravity/API Gravity | 0.8649/32.1 |
| Volume Percent | |
| IBP, °F. (°C.) | 516 (269) |
| 10 | 750 (399) |
| 30 | 750 (399) |
| 50 | 871 (466) |
| 70 | 937 (503) |
| 90 | 1061 (573) |
| 95 | — — |
| End point, Recovery 90% | 1061 (573) |
| Heavy Polynuclear Aromatic Compounds wppm | 600 |

Accordingly, the concentration of heavy polynuclear aromatic compounds which are introduced into the hydrocracking zone is greatly reduced which permits essentially complete conversion of the fresh feed to useful products while preventing the fouling of heat exchange equipment with precipitated heavy polynuclear aromatic compounds.

EXAMPLE II

A hydrocracking recycle liquid stream having the characteristics presented in Table 2 was introduced into a flash distillation zone operated at a variety of conditions in order to demonstrate preferred embodiments of the present invention and the results are presented and summarized in Table 3.

A composite flash distillation zone overhead was collected which included the overhead recovered from the two runs which were reported in Table 3 and this composite had an API gravity of 33.0 (0.8601 specific gravity) and contained 173 wppm heavy polynuclear aromatic (HPNA) compounds. This overhead composite was charged to a hydrogenation zone operated at conditions which included 200 psig (1379 kPa gauge), 401° F. (205° C.), a liquid hourly space velocity (LHSV) of $0.25hr^{-1}$, and a hydrogen circulation rate of 40,000 standard cubic feet per barrel (SCFB) (6740 normal $m^3/m^3$). The hydrogenation zone contained a catalyst containing alumina and palladium. The resulting liquid hydrocarbon effluent from the hydrogenation zone was analyzed and found to contain 28 wppm heavy polynuclear aromatic compounds which represented a removal or conversion of 83.8% of the heavy polynuclear aromatic compounds charged to the hydrogenation zone.

TABLE 2

| Hydrocracker Recycle Liquid Characterization | |
|---|---|
| Gravity, °API | 32.1 |
| Distillation-D 1160, °F. (°C.) | |
| IBP | 516 (269) |
| 5 | 666 (352) |
| 10 | 750 (399) |
| 30 | 822 (439) |
| 50% | 871 (466) |
| 70 | 937 (503) |
| 90 | 1062 (573) |
| 95 | — — |
| EP | 1062 (573) |
| % Over | 90 90 |
| % Resid | 10 10 |
| Elemental, wt. % | |
| Carbon | 85.7 |
| Hydrogen | 13.9 |
| Nitrogen | <0.02 |
| Sulfur | <0.05 |
| Total Aromatics, wt. % | 18.8 |
| Heavy Polynuclear Aromatics, wt. - ppm | 600 |

TABLE 3

| Flash Distillation Zone Summary | | |
|---|---|---|
| Operating Conditions | | |
| Pressure, PSIG (kPa Gauge) | 100 (689.5) | 500 (3447) |
| Temperature, °F. (°C.) | 772 (411) | 775 (411) |
| Hydrogen/Hydrocarbon, SCFB (Normal $M^3/M^3$) | 19,800 (336.5) | 20400 (3437.6) |
| Average Hydrocarbon Residence Time, Seconds | 1 | 1 |
| Yield Distribution, Wt. % | | |
| Overhead | 85.3 | 51.2 |
| Bottoms | 14.7 | 48.8 |
| HPNA Concentration, WPPM | | |
| Overhead | 205 | 88 |
| HPNA Rejection, Weight Percent | 70.9 | 92.5 |

The foregoing description, drawing and examples clearly illustrate the advantages encompassed by the process of the present invention and the benefits to be afforded with the use thereof.

What is claimed:

1. A catalytic hydrocracking process which comprises:

(a) contacting a hydrocarbonaceous feedstock having a propensity to form heavy polynuclear aromatic compounds and a liquid recycle stream in a hydrocracking zone with added hydrogen and a metal promoted hydrocracking catalyst at elevated temperature and pressure sufficient to convert a substantial portion of the hydrocabonaceous components in said feedstock to lower boiling products;

(b) recovering a hydrocarbon effluent from said hydrocracking zone and partially condensing the hydrocarbon effluent from said hydrocracking zone and separating the same into a lower boiling hydrocarbon product stream and an unconverted hydrocarbon stream having at least a portion boiling above about 400° F. and comprising trace quantities of heavy polynuclear aromataic compounds;

(c) introducing at least a portion of said unconverted hydrocarbon stream having at least a portion boiling above about 400° F. and comprising trace quantities of heavy polynuclear aromatic compounds into a hydrogen stripping flash zone with a first hydrogen-rich gaseous stream having a temperature greater than said hydrocarbon stream at flash conditions thereby increasing the temperature of said hydrocarbon stream and vaporizing at least a portion thereof to produce a vapor stream comprising hydrogen and hydrocarbon compounds and produce a liquid hydrocarbon stream comprising heavy polynuclear aromatic compounds;

(d) contacting said vapor stream comprising hydrogen and hydrocarbon compounds with a hydrogenation catalyst in a hydrogenation reaction zone at hydrogenation conditions to increase the hydrogen content of the hydrocarbon compounds contained in said vapor stream;

(e) condensing at least a portion of the resulting effluent from said hydrogenation reaction zone to produce a second hydrogen-rich gaseous stream and a liquid stream comprising hydrogenated hydrocarbon compounds;

(f) recycling at least a portion of said liquid stream comprising hydrogenated hydrocarbon compounds recovered in step (e) to said hydrocracking zone in step (a) as at least a portion of said liquid recycle stream; and (g) recycling at least a portion of said second hydrogen-rich gaseous stream to said first hydrogen-rich gaseous stream in step (c).

2. The process of claim 1 wherein said hydrocracking zone is maintained at a pressure from about 500 psig to about 3000 psig.

3. The process of claim 1 wherein said hydrocracking zone is maintained at a temperature from about 450° F. to about 850° F.

4. The process of claim 1 wherein said metal promoted hydrocracking catalyst comprises synthetic faujasite.

5. The process of claim 1 wherein said metal promoted hydrocracking catalyst comprises nickel and tungsten.

6. The process of claim 1 wherein said hydrocarbonaceous feedstock boils at a temperature greater than about 650° F.

7. The process of claim 1 wherein said unconverted hydrocarbon stream having at least a portion boiling above about 400° F. is introduced into said hydrogen stripping flash zone at a temperature less than about 700° F.

8. The process of claim 1 wherein the temperature of said first hydrogen-rich gaseous stream is from about 200° F. to about 1200° F.

9. The process of claim 1 wherein said hydrogen stripping flash zone conditions include a temperature from about 150° F. to about 860° F., a pressure from about atmospheric to about 2000 psig, a hydrogen circulation rate of about 1000 SCFB to about 30,000 SCFB based on said unconverted hydrocarbon stream introduced into said flash zone, and an average residence time of said vapor stream comprising hydrogen and hydrocarbon compounds in said flash zone from about 0.1 seconds to about 50 seconds.

10. The process of claim 1 wherein said hydrocarbonaceous feedstock having a propensity to form heavy polynuclear aromatic compounds comprises a component selected from the group consisting of vacuum gas oil, atmospheric gas oil, cracked gas oil, light cycle oil, heavy cycle oil, demetallized oil, and coker gas oil.

11. The process of claim 1 wherein said hydrogenation conditions include a pressure from about atmospheric to about 3000 psig, a liquid hourly space velocity from about 0.05 $hr^{-1}$ to about 20 $hr^{-1}$, a temperature from about 122° F. to about 850° F. and a hydrogen circulation rate from about 200 SCFB to about 50,000 SCFB.

* * * * *